US009132475B2

(12) United States Patent
Tomigashi et al.

(10) Patent No.: US 9,132,475 B2
(45) Date of Patent: Sep. 15, 2015

(54) MOLD MOLDING METHOD AND MOLD MOLDING MEMBER

(75) Inventors: Daisuke Tomigashi, Hokkaido (JP); Yoshikazu Itabashi, Hokkaido (JP); Seiji Kubo, Hokkaido (JP)

(73) Assignees: THE JAPAN STEEL WORKS, LTD., Tokyo (JP); NIKKO MEC CO., LTD., Hokkaido (JP)

( * ) Notice: Subject to any disclaimer, the term of this patent is extended or adjusted under 35 U.S.C. 154(b) by 0 days.

(21) Appl. No.: 13/876,579

(22) PCT Filed: Sep. 27, 2011

(86) PCT No.: PCT/JP2011/072122

§ 371 (c)(1),
(2), (4) Date: Mar. 28, 2013

(87) PCT Pub. No.: WO2012/043588

PCT Pub. Date: Apr. 5, 2012

(65) Prior Publication Data

US 2013/0186589 A1 Jul. 25, 2013

(30) Foreign Application Priority Data

Oct. 1, 2010 (JP) ..... 2010-223917

(51) Int. Cl.
*B22C 9/02* (2006.01)

(52) U.S. Cl.
CPC ..... *B22C 9/02* (2013.01)

(58) Field of Classification Search
CPC ..... B22C 9/02
USPC ..... 164/349, 520
See application file for complete search history.

(56) References Cited

U.S. PATENT DOCUMENTS 1,934,239 A * 11/1933 Schupp ..... 29/527.6

FOREIGN PATENT DOCUMENTS

| | | | | |
|---|---|---|---|---|
| CN | 1843664 | A | | 10/2006 |
| CN | 201389615 | Y | | 1/2010 |
| DE | 2022371 | A1 | | 12/1971 |
| JP | 56045250 | A | * | 4/1981 |
| JP | 59007460 | A | * | 1/1984 |
| JP | 60-131246 | U | | 9/1985 |
| JP | 2-220730 | A | | 9/1990 |
| JP | 10-24344 | A | | 1/1998 |

(Continued)

OTHER PUBLICATIONS

Baoding Balls, http://www.baodingballs.com/, May 14, 2007.*

(Continued)

*Primary Examiner* — Kevin E Yoon
(74) *Attorney, Agent, or Firm* — Sughrue Mion, PLLC

(57) ABSTRACT

An object is to provide a mold molding method which can provide a high general-purpose property and can reduce a usage quantity of molding sand. In a method for molding a mold (sand mold) by self-hardening molding sand using a caking additive, the mold is molded by disposing hollow spheres each formed to have no clearance therein among molding sand mixed with the caking additive. Preferably, the hollow sphere may be formed by working two metal plates to semispherical shapes and then connecting the semispherical-shaped metal plates to each other by welding their respective whole peripheries. A specific gravity of the hollow sphere may be 0.5 to 2.0 times a specific gravity of the molding sand.

11 Claims, 2 Drawing Sheets

(56) References Cited

FOREIGN PATENT DOCUMENTS

| | | | |
|---|---|---|---|
| JP | 2009-220143 | A | 10/2009 |
| JP | 2011-20148 | A | 2/2011 |

OTHER PUBLICATIONS

JPO machine translation of JP 2009-220143, Oct. 1, 2009.*

International Search Report for PCT/JP2011/072122, dated Dec. 20, 2011 [PCT/ISA/210].

Office Action, dated Oct. 16, 2013, issued by the Japanese Patent Office, in counterpart Application No. 2010-223917.

Communication dated Aug. 12, 2014 from the State Intellectual Property Office of P.R. China in a counterpart application No. 201180047791.8.

* cited by examiner

MOLD MOLDING METHOD AND MOLD MOLDING MEMBER

TECHNICAL FIELD

The present invention relates to a mold molding method for molding a sand mold to produce castings, and a mold molding member for use in this mold molding method.

BACKGROUND ART

In a molding method for molding a mold using molding sand, a caking additive is mixed into the molding sand, the mixture is loaded into a mold metal frame and the molding sand is hardened to thereby mold a mold.

Here, the mold metal frame is normally formed in a cuboid body, and a size thereof is determined according to the maximum width, height and length of a product. In this mold metal frame, since a wide clearance is produced due to a shape of a product that is not similar in shape to the mold metal frame, a large quantity of molding sand must be loaded into this clearance.

In order to cope with this, there have been proposed a sand reducing method using a jig such as a jig of a type for mounting a partition having a shape similar to a product onto the inner surface of the metal frame and a jig of a type in which a pipe type or block type jig is loaded together with sand. However, these jigs are low in the general-purpose property and thus are not suitable for multi-product production.

In view of this, as disclosed in PTL 1, there is proposed a method in which two semispherical iron-made cups are spot welded together into an iron-ball-shaped hollow ball having a clearance and the hollow ball is loaded among molding sand.

In this method, specifically, when loading molding sand into a molding frame, in a clearance formed between the molding frame and a product due to the shape of the product, there is disposed a hollow ball constituted of two semispherical cups which have been put together by spot welding with a given clearance between them. This may reduce the quantities of molding sand and caking additive used with a high general-purpose property. Also, since the clearance is secured using a spot welding method as the cups connecting method, the pressure of the internal expansion air of the cup produced due to the heat of the molten metal may be relieved.

CITATION LIST

Patent Literature

PTL 1: JP-UM-A-60-131246

SUMMARY OF INVENTION

Technical Problems

However, in the related-art method, since molds are different in bulk density according to materials used and thus, when handling, the weights of the molds may increase or the gravity thereof may be biased, so that the molds may lose their balance. This has a bad influence on a crane when hanging down the molds.

Also, the hollow ball proposed in PTL 1 is low in the connecting strength due to the spot-welded connection to raise a durability problem that the welded portion of the hollow ball may be broken in a mold dismantling operation such as a mold frame demolishing/collecting operation using a breaker. And, in the case of this hollow ball, since a space must be formed in the interior portion of the mold and the hollow ball must be used in this space, when the hollow ball is used simultaneously with the mold molding operation, sand may be flown into the hollow portion of the ball from the clearance thereof, so that the advantage that the ball is hollow may be lost. Also, the invasion of the sand into the hollow portion changes the bulk density of the mold, which may damage the balance of the mold and may worsen the collection efficiency of the molding sand.

Thus, in order to solve the above problems, the invention has an object to provide a mold molding method which can provide enhanced general-purpose property, which can reduce a usage quantity of molding sand, which can have good durability and which can be used while maintaining the hollow shape without changing the operation efficiency, and to provide a mold molding material.

Solution to Problem

That is, according to a first aspect of a mold molding method of the invention, there is provided a mold molding method for molding a mold by self-hardening molding sand using a caking additive, the method comprising disposing hollow spheres each having no clearance therein among molding sand that are mixed with the caking additive and molding the mold.

According to a second aspect of the mold molding method of the invention, in the first aspect, the hollow sphere is an iron ball.

According to a third aspect of the mold molding method of the invention, in the first or second aspect, the hollow sphere is formed by working two metal plates into semispherical shapes and then connecting the semispherical-shaped metal plates to each other by welding their respective whole peripheries.

According to a fourth aspect of the mold molding method of the invention, in the first aspect, the hollow sphere has mass of 1 kg to 5 kg and an outside diameter of 50 mm to 250 mm.

According to a fifth aspect of the mold molding method of the invention, in the first aspect, a specific gravity of the hollow sphere is 0.5 to 2.0 times a specific gravity of the molding sand.

According to a sixth aspect of the mold molding method of the invention, in the first aspect, the hollow sphere includes two or more kinds of hollow spheres respectively having different outside diameters.

Further, according to another aspect of the invention, there is provided a mold molding member, a plurality of which is configured to be disposed among molding sand for molding a mold, wherein each of the plurality of mold molding members is configured by hollow spheres each having no clearance therein, and a specific gravity of each of the hollow spheres is 0.5 to 2.0 times a specific gravity of the molding sand.

According to the invention, since the hollow spheres having no clearance therein are used while they are disposed among molding sand, the mold can provide a high general-purpose property and the quantities of molding sand and caking additive used can be reduced. Further, since the hollow sphere has no clearance therein, the invasion of molding sand can be avoided, thereby being able to secure the hollow space. Here, the expression "having no clearance" is used to mean a state where the invasion of molding sand is prevented at least from outside.

Although the hollow sphere producing method is not limited to any specific method, it is preferable that there may be used a method which can provide necessary strength and can produce the mold at a low cost. Preferably, there may be used a method in which two metal plates are respectively worked into semispherical cups and the semispherical cups are connected to each other in such a manner that the openings of the respective semispherical cups are butted against each other and the whole peripheries thereof are then welded together.

The whole periphery welding of the connecting portions can provide proper connecting strength for the two semispherical cups and can enhance the durability thereof. Further, the whole periphery welding can prevent the invasion of molding sand to thereby always maintain the hollow shape, whereby, even when a space is not formed in the interior portion of the mold separately, the hollow sphere can be loaded simultaneously with the loading of the molding sand.

Although the material of the hollow sphere is not limited to any special one, it is preferable to use a material which has such strength as has no problem with the internal expansion of the mold caused by heat of the molten metal and with the mold demolishing operation; specifically, the hollow sphere may preferably be constituted of an iron ball (made of an iron material or a steel material).

Also, by limiting the using area, the hollow sphere can be used only in the temperature area where the strength of the iron plate will not be lowered extremely and, by setting a given enough mold thickness, the leakage of the molten metal can be prevented. The thickness of the iron plate is determined in consideration of the mass of the iron ball in addition to the strength thereof.

A difference between the specific gravity of the hollow sphere and molding sand may preferably be small. That is, it is preferable that the mass of the hollow sphere may have specific gravity substantially equivalent to the molding sand having the same volume.

When the bulk specific gravity of the hollow sphere is excessively large, the mold provides an overload when it is moved or transported, and the eccentricity of the gravity of the mold causes the bias of the weight balance, thereby degrading the operation efficiency. When the bulk specific gravity is small, when loading the molding sand, the hollow sphere is moved to thereby degrade the operation efficiency. In order to reduce such influence, preferably, the hollow sphere used may have mass of 1 kg to 5 kg and a diameter of 50 mm to 250 mm. Further, the specific gravity of the hollow sphere may preferably be 0.5 to 2.0 times the specific gravity of the molding sand to be used. More preferable, the specific gravity of the hollow sphere may be 0.75 times to 1.25 times the specific gravity of molding sand to be used.

According thereto, the mold is easy to balance in weight, and when loading the hollow sphere into the mold frame (molding frame), the floating and sinking of the hollow sphere due to the specific gravity difference are hard to occur. When the specific gravity (bulk specific gravity including the hollow portion) of the hollow sphere is less than 0.5 times the specific gravity of the molding sand, the hollow sphere is relatively extremely light and thus it is hard to balance in mass; and, when the hollow sphere is loaded among molding sand, it is easy to float up. On the other hand, when the specific gravity of the hollow sphere is more than 2.0 times the specific gravity of the molding sand, the hollow sphere becomes relatively heavy that the mass thereof is hard to balance, and the hollow sphere may be easy to sink when the hollow sphere is loaded among molding sand. That is, by reducing the specific gravity difference, influences on the overload and gravity in the mold handling operation can be reduced, and in a vibration molding method, the flow or separation of the hollow sphere such the sinking or floating thereof can be prevented. Further, this is effective in preventing from crushing and deforming of a pattern which is made of foaming polystyrene and has been put into use recently.

DESCRIPTION OF EMBODIMENTS

One embodiment of the invention will now be described with reference to the accompanying drawings.

Figure 1:
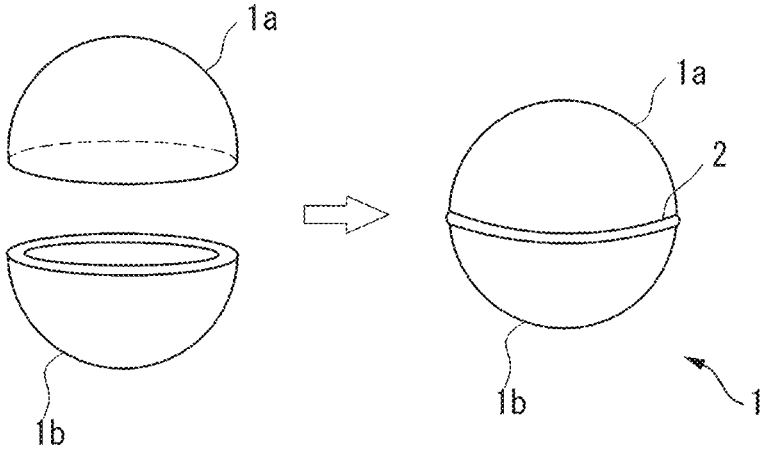
FIG. 1 is a view of the producing process of a hollow sphere according to an embodiment of the invention.
Figure 2:
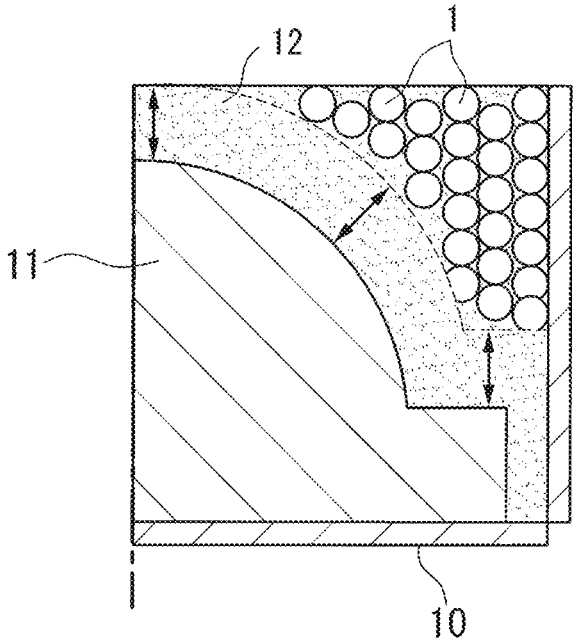
FIG. 2 shows a state where molding sand and hollow spheres are filled into a mold frame according to the embodiment.
Figure 3:
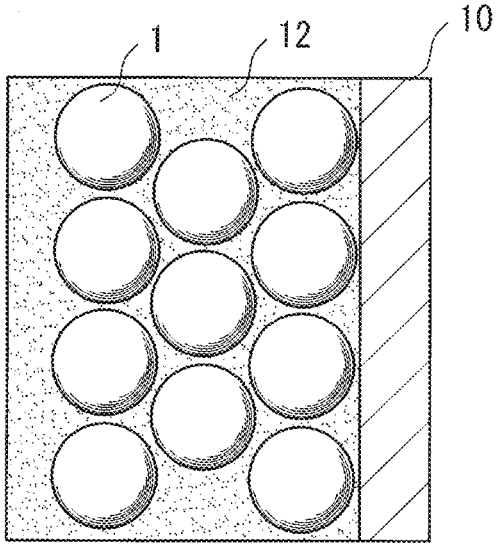
FIG. 3 is a partially enlarged view of the mold frame, showing a state where the hollow spheres are loaded therein.

Two iron plates are respectively press worked into two semispherical cups. Then, as shown in FIG. 1, the two semispherical cups 1*a* and 1*b* are butted against each other with their respective open sides opposed to each other, and the whole peripheries of the butted portions thereof are welded to have no clearance between them to thereby produce an iron ball 1 as a hollow sphere. In FIG. 1, reference numeral 2 designates the whole peripheral welded portion. Two or more iron balls 1 are prepared. The iron ball 1, preferably, may have mass of 1 kg to 5 kg and an outside diameter of 50 mm to 250 mm.

Further, there are prepared a mold frame 10, a pattern 11 providing the shape of a product, and self-hardening molding sand which is mixed with a caking additive in order to have the minimum compression strength to prevent the molding sand from flowing after hardened, that is, to prevent the molding sand from leaking from the clearance and ventilation holes of the mold frame 10. The specific gravity of the iron ball 1 may be 0.5 to 2.0 times that of the molding sand.

The molding sand is filled into the mold frame 10 before it is hardened while it is caused to fit the iron ball 1, thereby producing sand molds 12. In this case, the iron balls 1 are disposed spaced a given distance from the surface of the pattern 11, that is, the surface to provide a casting, in order that they are not in direct contact with the surface. However, the iron balls 1 may be in contact with the mold frame 10.

After the molding sand and iron balls 1 are filled into the mold frame 10, they are turned upside down together with the mold frame 10, and molten metal is molded into a space formed between the sand molds 12 after the pattern 11 is removed, thereby producing a product 13.

After that, the product 13 is removed. After the product is removed, the iron balls 1 are put into a collection device shaker together with the molding sand and other metal materials. The iron balls 1 are collected while separated from other metal materials by making use of their spherical shapes together with the inclination and vibration of a blade: that is, according to a method different from a method for collecting the other metal materials used as chiller, a cored bar and the like.

When collecting the iron balls 1, the iron balls 1 are hard to float or sink and are free from damage. Further, the hollow space can be maintained through the molding and collection, and the internal invasion of the molding sand can be prevented. Thus, the iron balls can be used repeatedly.

EXAMPLES

Example 1

In an example 1, there was used a metal frame having a product molding weight of 50 t and an internal capacity of a width 2,500 mm×length 4,500 mm×height 3,000 mm. Using mullite-system artificial sand and alkali phenol as the caking additive, a product was produced by self-hardening mold.

Figure 4:
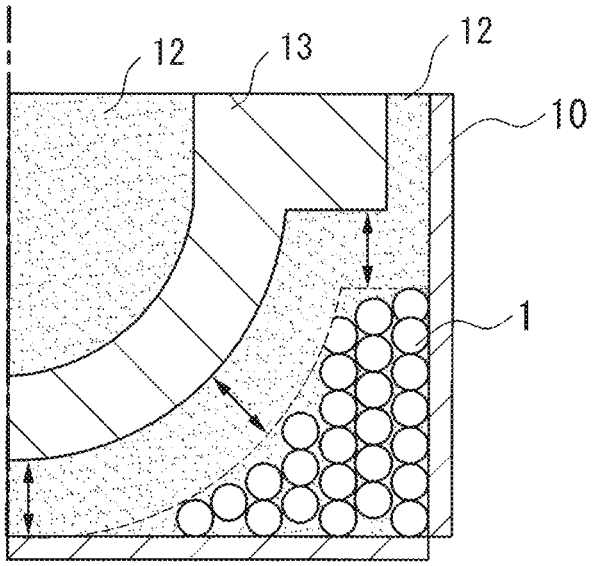
FIG. 4 is a view of a mold when a casting is produced.

To produce a product having a shape shown in FIG. 4, the molding sand and iron balls 1 were disposed within the metal frame while they were spaced 300 mm or more from the pattern, thereby molding a mold. In this case, each iron ball had an outside diameter of 140 mm and had specific gravity substantially equal to the sand.

Example 2

In an example 2, a product was produced by a self-hardening mold using zircon sand (specific gravity of 2.90) and the same alkali phenol. In this example, there were used iron balls each having a diameter of 120 mm and specific gravity of 2.5.

By using these iron balls, the quantity of sand necessary for filling was reduced 20% with respect to the related-art mass ratio.

Use of the iron balls having specific gravity that is substantially equal to the sand to be used can prevent the unstable balance or overload of the mold frame when handling the mold frame. Since the sand and iron balls were loaded spaced a given distance from the product, the molten metal did not leak during molding, and when demolishing the metal frame, heat influences on the iron balls such as melting loss and damage could not be found.

Reference Example 1

Mullite-System Artificial Sand

As a reference example 1, when producing a mold having the same condition as the example 1, there were used iron balls each having an outside diameter of 160 mm, weight of 7.5 kg and specific gravity of 3.5. Since a larger number of iron balls were loaded in the larger clearance portion, the center of gravity of the mold was biased, whereby, when reversing the mold, the mold and crane were damaged in some cases.

Further, since the mass of the mold was heavier, there was raised a fear that a lifting machine (crane or reversing machine) could be overloaded. In order to avoid this, the quantity of iron balls used had to be limited. Thus, the advantage of reducing the use quantity of sand was diminished when compared with the above-mentioned examples. Also, when an operator handles the mold (taking account of a situation where the operator works while having the iron balls in operator's hands), the mold provided a heavy load, so that the operation efficiency was degraded.

Reference Example 2

Zircon Sand

As a reference example 2, when producing a mold having the same condition as the example 2, there were used iron balls each having an outside diameter of 150 mm, weight of 0.9 kg and specific gravity of 0.6. When sand was dropped down from a sand mixer into the mold, in some case, the iron balls were moved due to the dropping power of the sand and the positions of the iron balls had to be corrected whenever moved, so that the operation efficiency was degraded. Also, since the iron balls were low in strength, when the mold was demolished and the iron balls were dropped down, some of the iron balls were damaged.

In the above reference examples 1 and 2 as well, the necessary usage quantity of sand could be reduced by virtue of using the iron balls. However, there were raised problems with the mass balance, strength and the like. This made it clear that it is preferable to set the mass and specific gravity of the hollow spheres properly.

The invention is not limited to the above-mentioned embodiments but it can be freely changed or improved properly. Also, the materials, shapes, dimensions, numeric values, modes, installation places and the like of the respective composing elements in the above embodiments are arbitrary and thus are not limitative so long as they can attain the invention.

Although the invention has been described heretofore specifically and with reference to its specific embodiments, it is obvious to persons skilled in the art that various changes and modifications can be added without departing from the spirit and scope of the invention.

This application is based on Japanese Patent Application No. 2010-23917 filed on Oct. 1, 2010 and thus the contents thereof are incorporated herein for reference.

INDUSTRIAL APPLICABILITY

As described above, according to the invention, in a mold molding method for molding a mold by hardening molding sand using a caking additive, the method includes deposing hollow spheres each having no clearance therein among molding sand that are mixed with the caking additive. Therefore, by filling the general-purpose hollow spheres as a substitute for sand into molds having various shapes into the mold, there can be provided advantages that the usage quantity of sand and the usage quantity of caking additive involved with the usage quantity of sand can be reduced.

Also, since the hollow spheres are disposed at positions distant from the product, when polishing and recycling the mold, there can be provided advantages that unburned residual additives in the portions thereof, which are distant from the product and are thus less thermally influenced, can be restricted and thus the polishing and recycling treatment can be reduced.

REFERENCE SIGNS LIST

1: Iron ball
2: Whole peripheral welded portion
10: Molding frame
11: Pattern
12: Sand mold
13: Product

The invention claimed is:

1. A mold molding method for molding a mold by hardening molding sand using a caking additive, the method comprising:

disposing hollow spheres each having no clearance therein among molding sand that are mixed with the caking additive; and molding the mold.

2. The mold molding method according to claim 1, wherein the hollow sphere is an iron ball.

3. The mold molding method according to claim 1, wherein the hollow sphere has mass of 1 kg to 5 kg and an outside diameter of 50 mm to 250 mm.

4. The mold molding method according to claim 1, wherein a specific gravity of the hollow sphere is 0.5 to 2.0 times a specific gravity of the molding sand.

5. The mold molding method according to claim 1, wherein the hollow sphere includes two or more kinds of hollow spheres respectively having different outside diameters.

6. A mold molding member, a plurality of which is configured to be disposed among molding sand for molding a mold, wherein each of the plurality of mold molding members is configured by hollow spheres each having no clearance therein, and when the molding members are disposed among the molding sand, each of the hollow spheres has a specific gravity of 0.5 to 2.0 times a specific gravity of the molding sand, and wherein each of the hollow spheres is configured by two semispherical-shaped metal plates welded to each other along their respective whole peripheries.

7. The molding member according to claim 6, wherein the specific gravity of the hollow spheres is 0.75 to 1.25 times the specific gravity of the molding sand.

8. The molding member according to claim 6, wherein the hollow sphere has mass of 1 kg to 5 kg.

9. An apparatus for molding a mold, comprising:

a plurality of mold molding members configured by hollow spheres having no clearance therein; and molding sand in which the molding members are disposed, each of the hollow spheres having a specific gravity of 0.5 to 2.0 times a specific gravity of the molding sand, and wherein each of the hollow spheres is configured by two semispherical-shaped metal plates welded to each other along their respective whole peripheries.

10. The apparatus for molding a mold according to claim 9, wherein the specific gravity of the hollow spheres is 0.75 to 1.25 times the specific gravity of the molding sand.

11. The apparatus for molding a mold according to claim 9, wherein the hollow sphere has mass of 1 kg to 5 kg.

* * * * *